US007500529B2

(12) United States Patent
Shah

(10) Patent No.: US 7,500,529 B2
(45) Date of Patent: Mar. 10, 2009

(54) METHOD AND APPARATUS FOR PREDICTING AND CONTROLLING SECONDARY KICKS WHILE DEALING WITH A PRIMARY KICK EXPERIENCED WHEN DRILLING AN OIL AND GAS WELL

(76) Inventor: Javed Shah, 11135 23A Avenue NW., Edmonton (CA) T6J 4W5

( * ) Notice: Subject to any disclaimer, the term of this patent is extended or adjusted under 35 U.S.C. 154(b) by 247 days.

(21) Appl. No.: 11/452,656

(22) Filed: Jun. 13, 2006

(65) Prior Publication Data

US 2007/0005252 A1 Jan. 4, 2007

(30) Foreign Application Priority Data

Jul. 4, 2005 (CA) ..... 2512437

(51) Int. Cl.
*E21B 21/08* (2006.01)

(52) U.S. Cl. ..... 175/25; 175/38; 175/48

(58) Field of Classification Search ..... 175/25, 175/38, 48

See application file for complete search history.

(56) References Cited

U.S. PATENT DOCUMENTS 5,174,375 A 12/1992 Mims et al.
5,265,680 A 11/1993 Withers et al.
5,732,776 A 3/1998 Tubel et al.
5,842,149 A 11/1998 Harrell et al.
6,192,980 B1 2/2001 Tubel et al.
6,257,332 B1 7/2001 Vidrine et al.
6,397,946 B1 6/2002 Vail, III
6,401,814 B1 6/2002 Owens et al.
6,679,336 B2 1/2004 Musselwhite et al.
6,712,145 B2 3/2004 Allamon
7,243,736 B2 * 7/2007 Shah ..... 175/48

FOREIGN PATENT DOCUMENTS

CA 2 436 134 1/2001

* cited by examiner

*Primary Examiner*—Giovanna C Wright
(74) *Attorney, Agent, or Firm*—Christensen O'Connor Johnson Kindness PLLC

(57) ABSTRACT

A method and apparatus for predicting and controlling secondary kicks, while dealing with a primary kick experienced when drilling an oil and gas well. The method includes a step of determining whether a different pressure per cubic meter of mud pit volume has been caused by a secondary kick by subtracting shut in drill pipe pressure (SIDPP) from shut in casing pressure (SICP) and dividing the derived sum by a kick volume in KPa per cubic meter from the primary kick. A further step is then taken of increasing casing pressure until casing pressure equals pit gain times (X) rate of change in casing pressure per cubic meter of pit gain plus (+) SIDPP.

2 Claims, 1 Drawing Sheet

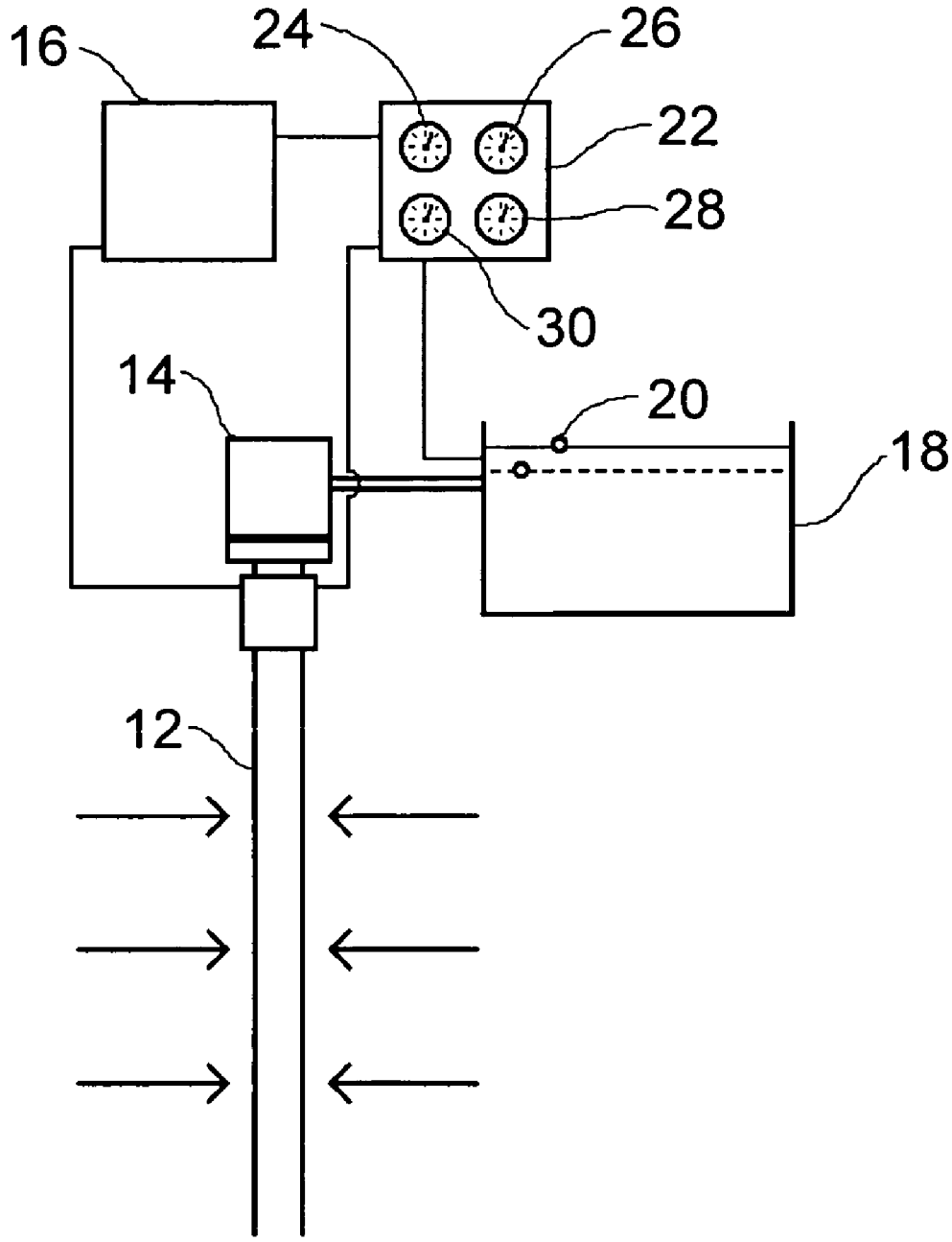
THE FIGURE

METHOD AND APPARATUS FOR PREDICTING AND CONTROLLING SECONDARY KICKS WHILE DEALING WITH A PRIMARY KICK EXPERIENCED WHEN DRILLING AN OIL AND GAS WELL

FIELD OF THE INVENTION

The present invention relates to a method and an apparatus for predicting and controlling secondary kicks while dealing with a primary kick experienced when drilling an oil and gas well.

BACKGROUND OF THE INVENTION

The loss of control or blow out condition for an oil and gas well always begins with a sudden change in down hole pressure caused by a rapid influx of fluids, commonly referred to as a "kick". Canadian Patent application 2,436,134 (Shah 2003) describes how to predict a kick is about to occur and maintain control over the well by circulating the kick. The Shah reference describes how to predict a kick is about to occur by such factors as an increase in volume in the mud pit as drilling fluids are displaced by incoming fluids. There presently exists a difficulty in predicting a secondary kick, while circulating the first kick.

SUMMARY OF THE INVENTION

What is required is a method and an apparatus for predicting and controlling secondary kicks while dealing with a primary kick experienced when drilling an oil and gas well.

According to one aspect of the present invention there is provided a method for predicting and controlling secondary kicks while dealing with a primary kick experienced when drilling an oil and gas well. The method includes a step of determining whether a different pressure per cubic meter of mud pit volume has been caused by a secondary kick by subtracting shut in drill pipe pressure (SIDPP) from shut in casing pressure (SICP) and dividing the derived sum by a kick volume in KPa per cubic meter from the primary kick. A further step is then taken of increasing casing pressure until casing pressure equals pit gain times (X) rate of change in casing pressure per cubic meter of pit gain plus (+) SIDPP.

According to another aspect of the present invention there is provided an apparatus for predicting and controlling secondary kicks while dealing with a primary kick experienced when drilling an oil and gas well. The apparatus is a choke controlled by a computer. The computer calculates whether a different pressure per cubic meter of mud pit volume has been caused by a secondary kick by subtracting shut in drill pipe pressure (SIDPP) from shut in casing pressure (SICP) and dividing the derived sum by a kick volume in KPa per cubic meter from the primary kick. Should a secondary kick be detected, the computer causes the choke to increase casing pressure until casing pressure equals pit gain times (X) rate of change in casing pressure per cubic meter of pit gain plus (+) SIDPP.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein:

THE FIGURE is a side elevation view, in section, of an oil and gas well equipped with an apparatus for predicting and controlling secondary kicks while dealing with a primary kick experienced when drilling an oil and gas well.

DETAILED DESCRIPTION OF THE PREFERRED EMBODIMENT

The preferred method will now be described with reference to THE FIGURE.

Referring now to THE FIGURE, there is shown an oil and gas well 12 with a choke 14. Choke 14 is controlled by a computer 16. Computer 16 receives data such as casing pressure, drill pipe pressure, and fluid level in the mud pit 18 based on the position of float 20. Computer 16 may receive this data through the choke control panel 22, which has displays 24, 26, and 28 for casing pressure, drill pipe pressure, and choke position for the operator, respectively. It may also have a display 30 for the fluid level.

Predicting if a Kick is Occurring Using the Pit Volume and Circulating Casing Pressure The casing pressure while circulating a kick out of hole, according to my observations, follows the rule:

$$\text{Casing Pressure} - \text{Pit gain} \times \text{Rate of change(in casing pressure/m}^3\text{ of pit gain)} + \text{SIDPP}$$

Using the above equation it can be determined if a secondary kick is taking place while circulating the first kick out of hole.

The difficulty in predicting the occurrence of a secondary kick while circulating the first kick has always been there in the oil industry.

The pit volume totalizers are not used in predicting the bottom hole pressure at all.

According to Observations Made on Initial Shut in of the Well

The shut in drill pipe pressure (SIDPP) reflects the underbalance between the formation pressure and the hydrostatic pressure created by the mud column inside the drill pipe.

The shut in casing pressure (SICP) reflects two things, these being that shut in drill pipe pressure is a part of the casing pressure observed at surface and the differential pressure between the hydrostatic pressure inside the drill pipe and the kick taken from the formation. That is why the casing pressure always reads higher than the drill pipe pressure.

$$\text{SIDPP} = \text{Formation Pressure} - \text{Hydrostatic Pressure}$$

$$\text{SICP} \equiv \text{SIDPP} + \text{DifferentialPressure}$$

Based on the above observation it can be predicted how high the casing pressure reads per cubic meter of kick volume (taken on the initial shut in of the well) in comparison to the shut in drill pipe pressure.

$$\text{Differential press/m}^3\text{ of Kick} = (\text{SICP} - \text{SIDPP})/\text{Original Kick Vol(kPa/m}^3)$$

To remove the possibility of taking a secondary kick (due to not holding the correct bottom hole pressure), the above value allows the choke operator to predict the amount of overkill or underbalance present in the well while circulating the first kick without stopping the pump.

After calculating the value of the casing pressure based on the amount of kick volume at any given time, the choke operator can stop the pump and check the SIDPP for the presence of overkill.

The casing pressure while circulating a kick out of hole, follows the rule:

$$\text{Casing Pressure}=[\text{Pit gain}\times\text{Rate of change(in csg press/m}^3\text{ of pit gain)}]+\text{SIDPP}$$

Using the above equation, it can be determined if a secondary kick is taking place while circulating the first kick out of hole.

If the correct bottom bole pressure was not being held, adjustments can be made to the pressures to avoid taking any more influx into the well bore.

Using this process a computer controlled choke could be put on the rig and the choke adjustment can be handled by the computer to allow for correct bottom hole pressure throughout the kick circulation. This would require a feed from the pit volume totalizers to the computer to predict the casing pressure and make necessary adjustments to the casing pressure during the kick circulation.

The same prediction of rate of change can allow the kick circulation to be carried out (when due to downhole equipment a SIDPP can not be obtained like the use of mud motors) using the change in CP based on the pit volume totalizers.

At the end of the kick circulation the SICP equals the SIDPP so that the density can be increased to kill the well.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiment of the invention in which an exclusive property or privilege is claimed are defined as follows:

1. A method for predicting and controlling secondary kicks while dealing with a primary kick experienced when drilling an oil and gas well, comprising the steps of:

determining whether a different pressure per cubic meter of mud pit volume has been caused by a secondary kick by subtracting shut in drill pipe pressure (SIDPP) from shut in casing pressure (SICP) and dividing the derived sum by a kick volume in KPa per cubic meter from the primary kick; and increasing casing pressure until casing pressure equals pit gain times (×) rate of change in casing pressure per cubic meter of pit gain plus (+) SIDPP.

2. An apparatus for predicting and controlling secondary kicks while dealing with a primary kick experienced when drilling an oil and gas well, comprising:

a choke controlled by a computer;

the computer calculating whether a different pressure per cubic meter of mud pit volume has been caused by a secondary kick by subtracting shut in drill pipe pressure (SIDPP) from shut in casing pressure (SICP) and dividing the derived sum by a kick volume in KPa per cubic meter from the primary kick; and should a secondary kick be detected, the computer causes the choke to increase casing pressure until casing pressure equals pit gain times (×) rate of change in casing pressure per cubic meter of pit gain plus (+) SIDPP.

* * * * *